United States Patent [19]

Varga

[11] 4,337,721

[45] Jul. 6, 1982

[54] PROCESSING HOT MELT ADHESIVE

[75] Inventor: Richard S. Varga, Akron, Ohio

[73] Assignee: The B. F. Goodrich Company, Akron, Ohio

[21] Appl. No.: 890,449

[22] Filed: Mar. 27, 1978

[51] Int. Cl.[3] ..... B05C 5/00

[52] U.S. Cl. ..... 118/60; 118/59; 118/69; 118/126; 118/315

[58] Field of Search ..... 118/69, 123, 126, 235, 118/315, 413, 415, 412, 59, 60

[56] References Cited

U.S. PATENT DOCUMENTS

| | | | |
|---|---|---|---|
| 519,194 | 5/1894 | Murphy | 118/415 X |
| 2,251,295 | 8/1941 | Sheesley | 118/126 X |
| 2,327,627 | 8/1943 | Esselen | 425/224 X |
| 2,426,572 | 8/1947 | Alderfer | 118/413 |
| 2,488,446 | 11/1949 | Swiss | 425/224 X |
| 2,712,508 | 7/1955 | Massey | 118/413 X |
| 2,889,806 | 6/1959 | Conant | 118/69 X |
| 3,007,200 | 11/1961 | Paulsen et al. | 425/224 |
| 3,056,384 | 10/1962 | Beale et al. | 118/415 X |
| 3,157,528 | 11/1964 | Strahl | 118/69 X |
| 3,192,893 | 7/1965 | Bauer et al. | 118/69 |
| 3,587,525 | 6/1971 | Fleischer | 118/415 X |

*Primary Examiner*—Shrive P. Beck
*Attorney, Agent, or Firm*—Joseph Januszkiewicz

[57] ABSTRACT

An extruder having a vertically disposed feed screw depositing a hot melt adhesive as an extrudate laterally across a carrier member. A blade with a back-up roller regulates the flow onto the moving carrier member which along with the film formed thereon is cooled and thence selectively either rolled up with the carrier member into a roll or separated therefrom and rolled up onto itself as a supply roll of adhesive.

1 Claim, 3 Drawing Figures

PROCESSING HOT MELT ADHESIVE

BACKGROUND OF THE INVENTION

This invention relates to an apparatus for making hot melt adhesive and more particularly to an apparatus for making a thin layer of adhesive and winding it onto a reel for subsequent usage.

There has been a need for applying a thin coat of an adhesive to various surfaces of articles that then require the application of a second article to the adhesive-coated first article. The space requirements in manipulating the articles and the adhesive applying machinery present problems that are complicated by the flow process and the necessary drying time between application of the adhesive and the adhering of the second article to the first article. Apparatus heretofore used have unsuccessfully tried extruders but the down-time was considerable due to overheating of the feed flight section of the extruders, causing the low melt adhesive ingredients to melt, and plug the feed section. The present invention provides an economical self feeding means in the form of a vertically deposited extruder for preparing a hot melt adhesive which is deposited as a thin layer onto a flexible disposable carrier member so that the applied adhesive can be stored and subsequently can be used conveniently in a process requiring a thin application of a film of adhesive.

SUMMARY OF THE INVENTION

The present invention contemplates the use of an extruder with its feed screw in a vertical position whereby it discharges the extrudate as a hot melt adhesive along the width of a moving flexible carrier member. A blade and a back-up roller are cooperative with the carrier member downstream of where the extruder deposits its extrudate onto the carrier member to regulate the amount of film deposited. One cooling roll cools the film indirectly while a second cooling roll then cools the film directly to facilitate the windup onto a take-up roll.

DETAILED DESCRIPTION

Figure 1:
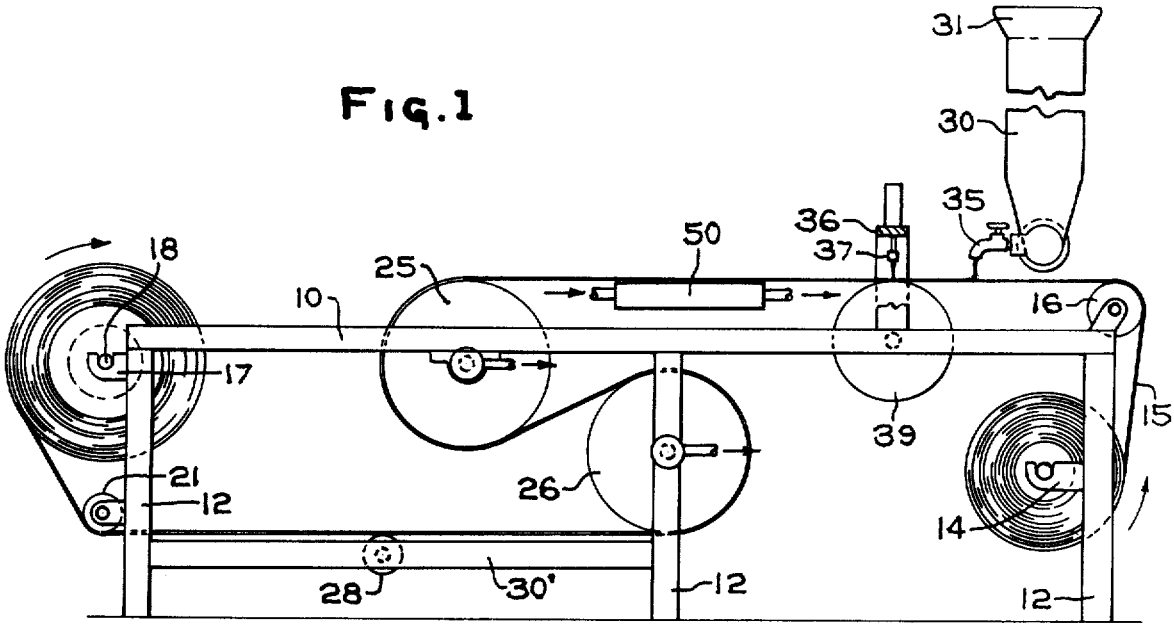
FIG. 1 is a fragmentary side elevational view of the preferred embodiment of the apparatus for making a thin layer of a hot melt adhesive on a disposable carrier member.
Figure 2:
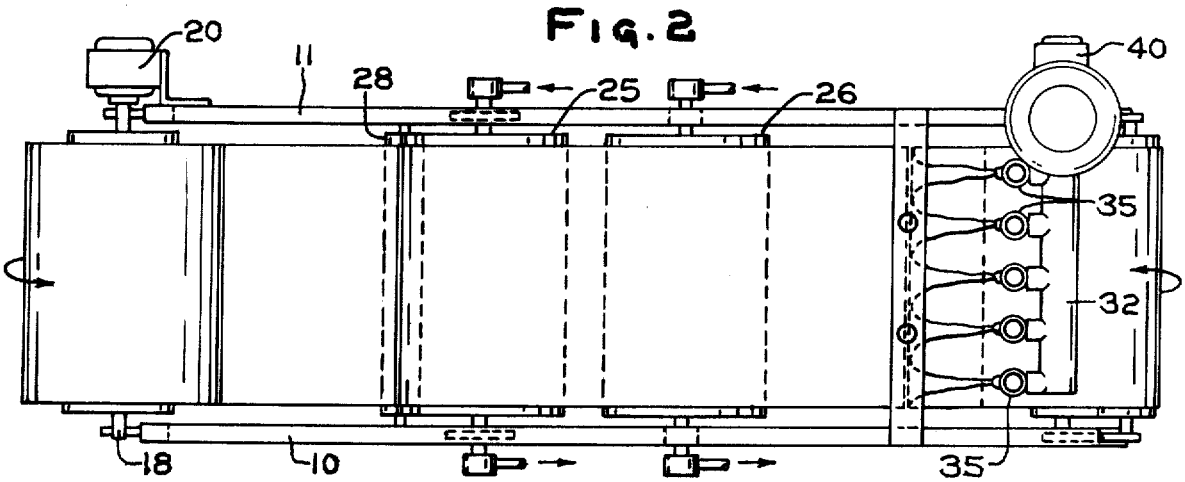
FIG. 2 is a plan view of the hot melt adhesive applying apparatus shown in FIG. 1.

Referring now to the drawings, wherein like reference numerals designate like or corresponding parts throughout the several views, there is shown in FIG. 1 and FIG. 2 a pair or laterally spaced horizontally extending support members 10 and 11 suitably supported by vertically extending braces 12. The support members 10 and 11 along with braces 12 make up the supporting framework. Mounted at the forwardly disposed vertical pair of braces 12 are brackets 14 which support a shaft which has a rolled up carrier member 12 thereon. The carrier member is a roll of disposable silicone treated paper which allows the adhesive film to be released from the carrier member. An idler roller 16 is mounted above brackets 14 to direct the carrier member from a vertical pass line to a horizontal pass line. Mounted on the rearward braces 12 are brackets 17 to support a wind-up or take-up shaft 18 driven by motor 20. The speed of motor 20 is controlled by means well known in the art. An idler roller 21 is mounted on the lower portion of the braces 12 that supports brackets 16 to facilitate the movement of carrier member 15 for windup on shaft 18. A cooling drum 25 is journaled for rotation on the intermediate portion of horizontal support members 10 and 11. A second cooling drum 26 is mounted for rotation on a pair of vertically extending braces 12 that are located at approximately the intermediate portion of the supporting framework. Cooling drums 25 and 26 are supplied with coolant to act as heat exchangers for cooling the thin film of adhesive that is carried by carrier member 15 as it is trained about such drums 25 and 26 on its way for windup on the take-up shaft 18. An additional idler support roller 28 is journaled for rotation on a pair of horizontally extending brackets 30' that extend between the rearwardly disposed braces 12 and braces 12 that are located at approximately the intermediate portion of the supporting framework. The number and location of rollers and the supporting framework may vary since the structure defined is only one example of the manner in which the invention can be employed. An extruder 30 having a hopper 31 and a discharge manifold 32 is suitably mounted on the forward portion of the supporting framework adjacent to roller 16 with its working screw disposed in a vertical position. The discharge manifold 32 has a plurality of laterally spaced valves 35 operative to deposit a hot melt adhesive from the extruder 30 onto the carrier member 15 passing therebelow. Mounted downstream from the extruder 30 is a cross brace 36 suitably supported on the support members 10 and 11. A doctor blade 37 suitably adjustably mounted on cross brace 36 regulates the amount of hot melt adhesive that is allowed to remain on the carrier member 15 as carrier member 15 moves past such blade. An idler back-up roller 39 is mounted opposite the doctor blade 37 and is in rolling contact with the underneath surface of carrier member 15 as it passes beneath blade 37 between rollers 16 and 25 to assure that a consistent thickness of film is deposited on carrier member 15.

In the operation of the described apparatus, a combination of the ingredients of the hot melt adhesive is blended and then the powder is fed into the hopper 31 of the vertically disposed extruder 30 where the powder is converted by the extruder to a hot melt which is then zone extruded onto the moving carrier member 15. The vertically disposed extruder is important in the instant combination by permitting a proper feed, which is a self feeding movement of the melt. The extruder provides the necessary shearing action as well as heat to provide a uniform feed. The blade 37 in cooperation with the backup roller 39 acts as a control means and the blade is adjustable to regulate the thickness of the hot melt adhesive that is deposited onto the carrier member 15. The carrier member 15 with the hot melt adhesive is guided over cooling rollers 25 and 26 for windup onto shaft 18. A motor 40 is suitably mounted on the framework having its output geared to drive the feed screw in the extruder 30 and the feed screw in the manifold 32.

A modification of the apparatus is shown in FIG. 1 wherein a cooling member 50 is mounted in the framework between the cooling roller 25 and the backup roller 39. Such cooling member is utilized where the hot melt adhesive is pressure sensitive and it is necessary to cool and then wind-up without having the hot melt adhesive contact the cooling roller 26. In this instance the hot melt adhesive is extruded as described above, and deposited on the carrier member 15. The hot melt adhesive is deposited as a thin film by blade 37 in cooperation with the back-up roller 39. As the carrier member 15 and the hot melt adhesive film passes over cooling member 50, they are cooled and thence wound up onto the windup shaft 18 driven by motor 40. In this instance the carrier member 15 and the film passes directly to the windup shaft 18 without passing over drum 26. Cooling roller 25 may be eliminated in this instance and have cooling member 50 do the entire cooling.

Figure 3:
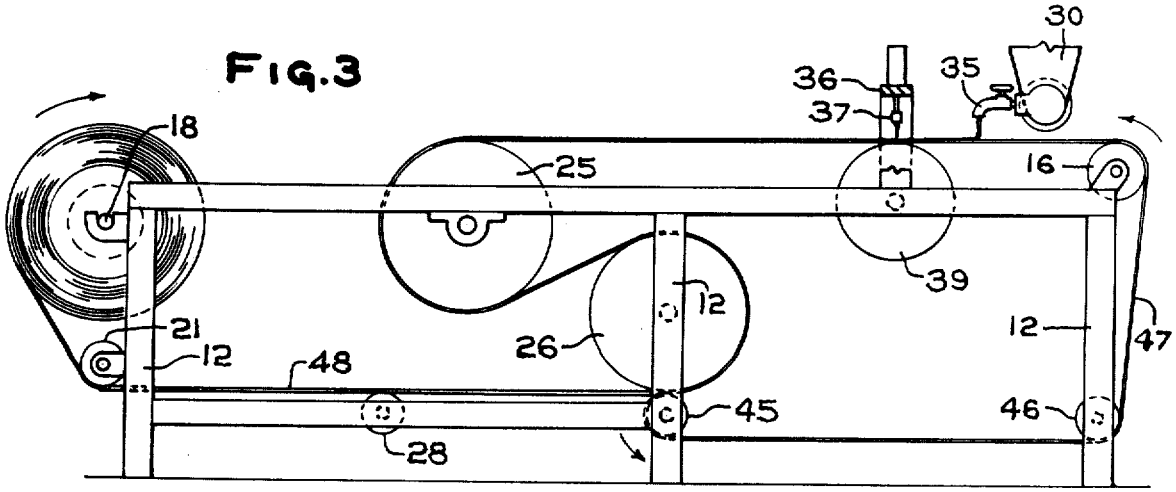
FIG. 3 is a side elevational view of a modified form of the apparatus shown in FIG. 1 for making a hot melt adhesive in a continuous thin length film for windup.

A further modification of the apparatus and process is shown in FIG. 3 wherein like reference parts designate like parts such as the braces 12, shaft 18, rollers 16, 21, 28, 25, and 26, extruder 30, valves 35, doctor blade 37, and back-up roller 39. Journaled respectively on the intermediate vertical brace 12 and the forwardly disposed vertical brace 12 are rollers 45 and 46. As described in the first embodiment, drive motor 40 drives the feed screws for the extruder 30 and manifold 32. Another drive motor rotates roller 16 which has trained about it a carrier member 47 which is a closed loop carrier member that is also trained about cooling rollers 25, 26, and idler rollers 45 and 46.

In this embodiment the discharge from the extruder 30 is deposited as a thin film on carrier member 47 which moves past doctor blade 37 and onto cooling drum 25 so that only the carrier member 47 is in contact with the cooling drum 25. As the carrier member and adhesive come off of cooling roller 25, the adhesive side comes into direct contact with the cooling drum 26. As the carrier member 47 and the adhesive leaves roller 26, the adhesive indicated as 48 is stripped from the carrier member 47 and is directed past rollers 28 and 21 for windup onto shaft 18 while the carrier member 47 continues around roller 45 for movement around roller 46 and thence directed upward to driven roller 16.

It will be apparent that although a specific embodiment and a certain modification of the invention has been described in detail, the invention is not limited to the specifically illustrated and described constructions since variations may be made without departing from the principles of the invention.

I claim:

1. An apparatus for preparing a thin film of hot melt adhesive for deposit on a disposable carrier member for stripping therefrom comprising support means, a supply roll mounted on one end of said support means, said disposable carrier member rolled up on said supply roll for unwinding therefrom, a take-up roll mounted on the other end of said support means, said disposable carrier member extending from said supply roll to said take-up roll, drive means connected to said take-up roll for rotating said roll, an extruder mounted adjacent to said one end of said support means for extruding a thin film of adhesive onto said carrier member, said extruder has a feed screw that is located in a vertical direction for depositing its feed onto said carrier member, cooling means mounted on said support means for direct contact with said carrier member for cooling said hot melt adhesive as said adhesive moves with said carrier member from said supply roll to said take-up roll, control means mounted on said support means between said cooling means and said extruder, said control means cooperative with said carrier member to regulate the thickness of deposit of said hot melt adhesive passing toward said cooling means with said carrier member, said carrier member being a disposable silicone roll of paper, said extruder having a plurality of laterally spaced discharge valves for spreading the output of said extruder across said carrier member, said control means includes a back-up roller operative to contact the underside of said carrier member, an elongated blade extending across said carrier member opposite said back-up roller for regulating the amount of hot melt adhesive passing underneath said blade for deposit onto said carrier member, said cooling means includes a pair of cooling rollers upon which said carrier member is trained as it moves past said blade to said take-up roll, cooling means connected to said pair of cooling rolls for removing heat from said carrier member and said hot melt adhesive, said cooling means includes an elongated cooling box operative to support said carrier member as said carrier member passes from said control means to said take-up roll, and said pair of rollers are located on said support means to direct said carrier member into an S-shaped loop to expose said carrier member directly to the first one of said pair of cooling rollers and thence expose said hot melt adhesive directly to the remaining one of said pair of cooling rollers.

* * * * *